US010526170B2

(12) United States Patent
Shiraishi et al.

(10) Patent No.: US 10,526,170 B2
(45) Date of Patent: Jan. 7, 2020

(54) ELEVATOR APPARATUS

(71) Applicant: MITSUBISHI ELECTRIC CORPORATION, Chiyoda-ku (JP)

(72) Inventors: Naohiro Shiraishi, Chiyoda-ku (JP); Eiji Ando, Chiyoda-ku (JP); Seiji Watanabe, Chiyoda-ku (JP); Kotaro Fukui, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 310 days.

(21) Appl. No.: 15/527,921

(22) PCT Filed: Nov. 19, 2014

(86) PCT No.: PCT/JP2014/080633
§ 371 (c)(1),
(2) Date: May 18, 2017

(87) PCT Pub. No.: WO2016/079823
PCT Pub. Date: May 26, 2016

(65) Prior Publication Data

US 2018/0319626 A1 Nov. 8, 2018

(51) Int. Cl.
*B66B 5/04* (2006.01)
*B66B 5/24* (2006.01)
*B66B 5/28* (2006.01)

(52) U.S. Cl.
CPC ..... *B66B 5/044* (2013.01); *B66B 5/24* (2013.01); *B66B 5/282* (2013.01)

(58) Field of Classification Search
CPC ..... B66B 5/044; B66B 5/24; B66B 5/282
See application file for complete search history.

(56) References Cited

U.S. PATENT DOCUMENTS 6,360,847 B1 * 3/2002 Okada ..... B66B 5/044 187/373
2013/0220739 A1 8/2013 Okada et al.

FOREIGN PATENT DOCUMENTS

| | | |
|---|---|---|
| CN | 102387977 | 3/2012 |
| EP | 2243739 A2 | 10/2010 |
| JP | 49-118471 | 11/1974 |
| JP | 53-71445 | 6/1978 |

(Continued)

OTHER PUBLICATIONS

Machine Translation of Abstract JP 06-16360.*

(Continued)

*Primary Examiner* — Diem M Tran
(74) *Attorney, Agent, or Firm* — Xsensus LLP

(57) ABSTRACT

In an elevator apparatus, an abnormal acceleration detecting mechanism detects abnormal acceleration of an ascending/descending body due to breakage of a suspending body, and activates a safety device. The abnormal acceleration detecting mechanism includes: an inertia sheave that is rotatable around a sheave shaft independently from an interlocking sheave; a pawl that is connected to the interlocking sheave and the inertia sheave, and that is displaceable between a normal position, and an activating position that displaces a movable shoe to a gripping position; and an elastic body that holds the pawl in the normal position by applying an initial pressure, and that also rotates the inertia sheave together with the interlocking sheave.

4 Claims, 4 Drawing Sheets

(56) References Cited

FOREIGN PATENT DOCUMENTS

| | | | | | |
|---|---|---|---|---|---|
| JP | 54-126352 | A | | 10/1979 | |
| JP | 06016360 | A | * | 1/1994 | ..... B66B 5/044 |
| WO | 2010116503 | | | 10/2010 | |
| WO | 2012/059970 | A1 | | 5/2012 | |

OTHER PUBLICATIONS

Chinese Office Action dated Jun. 11, 2018 in Chinese Application No. 201480083485.3 with English translation.
International Search Report dated Feb. 24, 2015, in PCT/JP2014/080633, filed Nov. 19, 2014.

* cited by examiner

ELEVATOR APPARATUS

TECHNICAL FIELD

The present invention relates to an elevator apparatus in which an ascending/descending body is made to perform emergency stopping using a safety device if a suspending body that suspends the ascending/descending body breaks.

BACKGROUND ART

In conventional elevator apparatuses, a torsion spring is disposed on a shaft of an activating lever that activates a safety device. The torsion spring applies torque in an opposite direction to a direction that activates the safety device to the activating lever. A mass body is constituted by a speed governor, a speed governor rope, and a tensioning sheave. Force that is required in order to activate the safety device and inertial mass of the mass body are adjusted so as to be able to activate the safety device if the suspending body breaks and the car is falling (see Patent Literature 1, for example).

CITATION LIST

Patent Literature

[Patent Literature 1]
International Publication No. WO/2012/059970

SUMMARY OF THE INVENTION

Problem to be Solved by the Invention

In conventional elevator apparatuses such as that described above, the safety device is activated by detecting an abnormal acceleration state of the car using differences in the forces of inertia that arise between the car and the speed governor rope system, but because the force of inertia of the speed governor rope system differs depending on specifications of the elevator apparatus (such as the hoisting zone of the car and the cross-sectional diameter of the speed governor rope, for example), various constraints arise on design of the safety device and adjustment thereof at the factory.

The present invention aims to solve the above problems and an object of the present invention is to provide an elevator apparatus that can activate a safety device when a suspending body breaks, without having to wait for car speed to reach an overspeed, and in which adjustment for activating the safety device can be performed easily irrespective of specifications.

Means for Solving the Problem

An elevator apparatus according to the present invention includes: a car; a suspending body that suspends the car; a hoisting machine that raises and lowers the car by means of the suspending body; a safety device that is mounted to the car, and that makes the car perform emergency stopping; an activating rope that is installed in a loop inside a hoistway, and that is connected to the safety device; an interlocking sheave onto which the activating rope is wound, and that rotates around a sheave shaft together with the raising and lowering of the car; a movable shoe that is displaceable between a separated position that is separated from the activating rope, and a gripping position in which the activating rope is gripped, the movable shoe being held in the separated position during normal operation; and an abnormal acceleration detecting mechanism that detects abnormal acceleration of the car due to breakage of the suspending body, and that displaces the movable shoe to the gripping position to activate the safety device, wherein: the abnormal acceleration detecting mechanism includes: an inertia sheave that is rotatable around the sheave shaft independently from the interlocking sheave; a pawl that is connected to the interlocking sheave and the inertia sheave, and that is displaceable between a normal position, and an activating position that displaces the movable shoe to the gripping position; and an elastic body that holds the pawl in the normal position by applying an initial pressure, and that also rotates the inertia sheave together with the interlocking sheave; and a force of inertia that acts between the interlocking sheave and the inertia sheave exceeds the initial pressure if acceleration of the car reaches the abnormal acceleration due to breakage of the suspending body, giving rise to a shift of the interlocking sheave in a direction of rotation relative to the inertia sheave such that the pawl displaces to the activating position to displace the movable shoe to the gripping position.

Effects of the Invention

In the elevator apparatus according to the present invention, because the pawl is displaced to the activating position using the force of inertia that acts between the interlocking sheave and the inertia sheave to activate the safety device when a suspending body breaks, the safety device can be activated without having to wait for car speed to reach an overspeed, and adjustment for activating the safety device can be performed easily irrespective of specifications.

DESCRIPTION OF EMBODIMENTS

A preferred embodiment of the present invention will now be explained with reference to the drawings.

Embodiment 1

Figure 1:
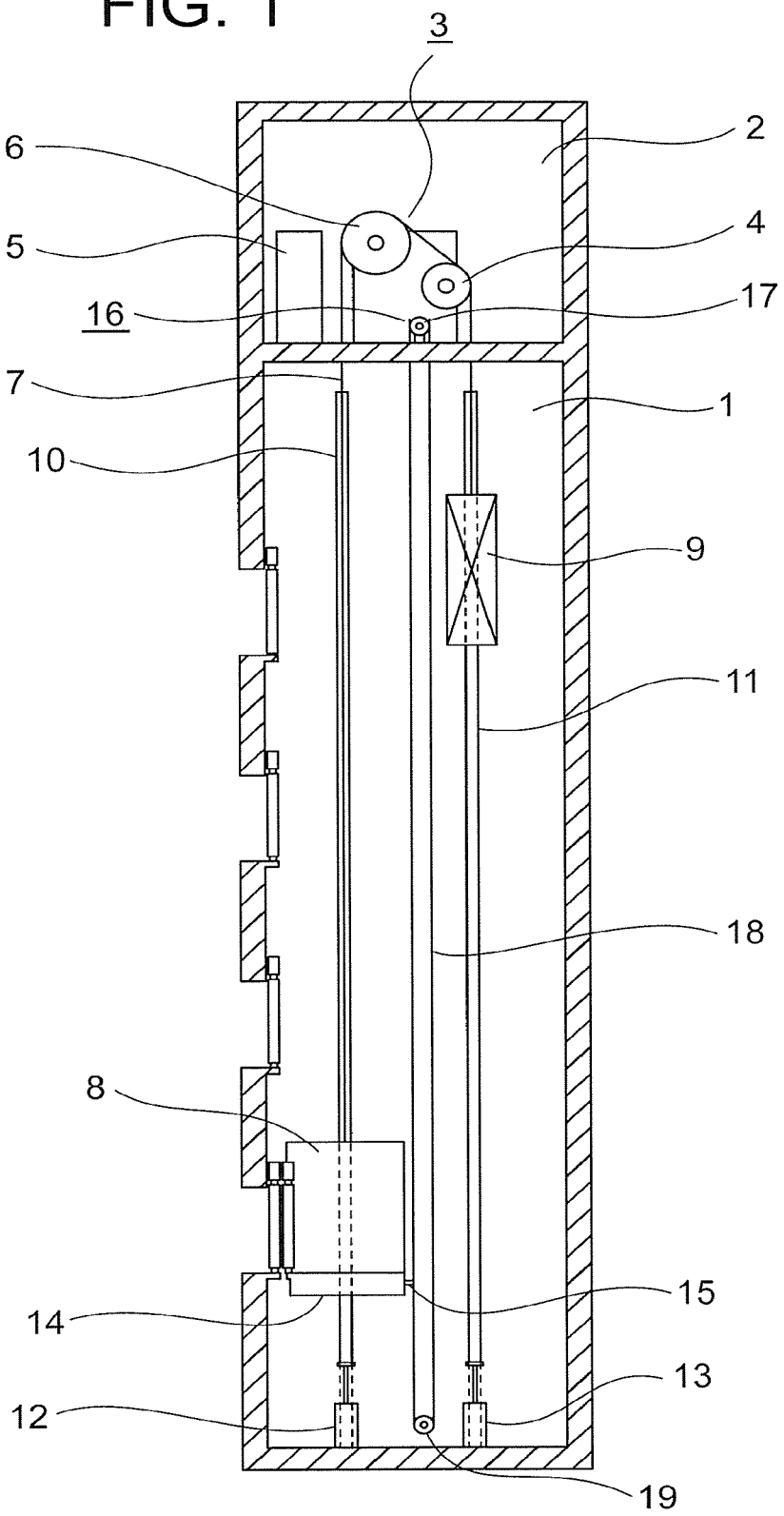
FIG. 1 is a configuration diagram that shows an elevator apparatus according to Embodiment 1 of the present invention.

FIG. 1 is a configuration diagram that shows an elevator apparatus according to Embodiment 1 of the present invention. In the figure, a machine room 2 is disposed in an upper portion of a hoistway 1. A hoisting machine (a driving apparatus) 3, a deflecting sheave 4, and a controlling apparatus 5 are installed in the machine room 2. The hoisting machine 3 has: a driving sheave 6; a hoisting machine motor (not shown) that rotates the driving sheave 6; and a hoisting machine brake (not shown) that brakes rotation of the driving sheave 6.

A suspending body 7 is wound onto the driving sheave 6 and the deflecting sheave 4. A plurality of ropes or a plurality of belts are used as the suspending body 7. A car 8 that functions as an ascending/descending body is connected to a first end portion of the suspending body 7. A counterweight 9 is connected to a second end portion of the suspending body 7.

The car 8 and the counterweight 9 are suspended inside the hoistway 1 by the suspending body 7 so as to be raised and lowered inside the hoistway 1 by a driving force that is generated by the hoisting machine 3. In other words, the hoisting machine 3 raises and lowers the car 8 and the counterweight 9 by means of the suspending body 7. The controlling apparatus 5 raises and lowers the car 8 at a set speed by controlling rotation of the hoisting machine 3.

A pair of car guide rails 10 that guide raising and lowering of the car 8 and a pair of counterweight guide rails 11 that guide raising and lowering of the counterweight 9 are installed inside the hoistway 1. A car buffer 12 and a counterweight buffer 13 are installed on a bottom portion of the hoistway 1.

A safety device 14 that makes the car 8 perform emergency stopping by gripping a car guide rail 10 is mounted onto a lower portion of the car 8. An activating lever 15 that activates the safety device 14 is disposed on the safety device 14.

A speed governor 16 that monitors for overspeed traveling of the car 8 is disposed in the machine room 2. A speed governor sheave 17 that functions as an interlocking sheave is disposed on the speed governor 16. A speed governor rope 18 that functions as an activating rope is wound around the speed governor sheave 17.

The speed governor rope 18 is installed in a loop inside the hoistway 1, and is connected to the activating lever 15. The speed governor rope 18 is wound around a tensioning sheave 19 that is disposed in a lower portion of the hoistway 1. The speed governor sheave 17 rotates together with the raising and lowering of the car 8. Specifically, the speed governor rope 18 moves cyclically as the car 8 is raised and lowered, rotating the speed governor sheave 17 at a rotational speed that corresponds to the traveling speed of the car 8.

The traveling speed of the car 8 reaching overspeeds is detected mechanically by the speed governor 16. A first overspeed Vos that is higher than a rated speed Vr and a second overspeed Vtr that is higher than the first overspeed are set as detected overspeeds.

An overspeed detecting switch (not shown) is operated if the traveling speed of the car 8 reaches the first overspeed Vos. Power supply to the hoisting machine 3 is interrupted thereby, activating the hoisting machine brake to stop the car 8 urgently.

If the descent speed of the car 8 reaches the second overspeed Vtr, the speed governor rope 18 is gripped to stop the cycling of the speed governor rope 18. The activating lever 15 is operated thereby, tripping the safety device 14 to make the car 8 to perform emergency stopping.

Figure 2:
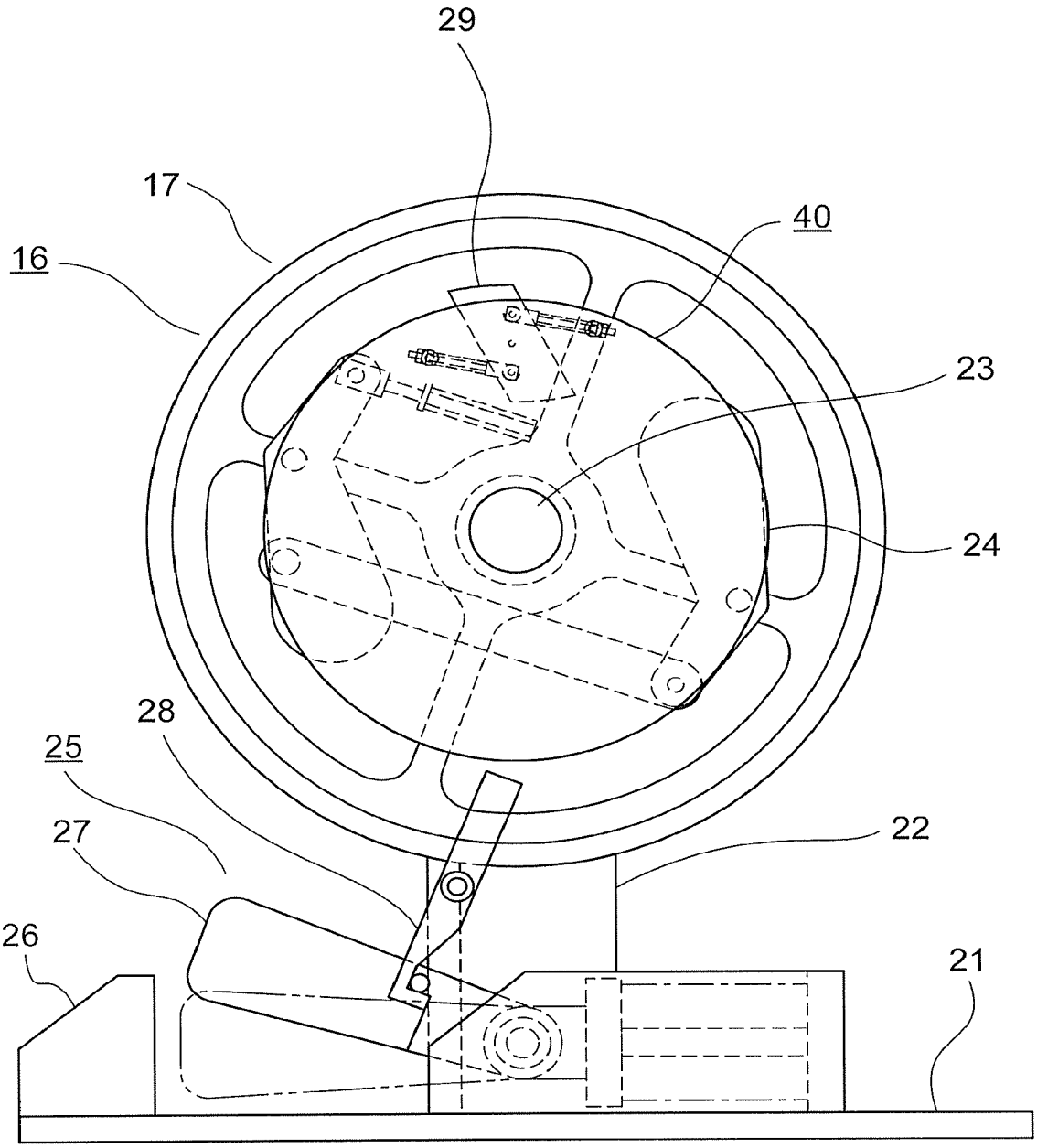
FIG. 2 is a front elevation that shows a speed governor from FIG. 1 enlarged.

FIG. 2 is a front elevation that shows the speed governor 16 from FIG. 1 enlarged. A sheave supporting member 22 is fixed to a base 21. The sheave supporting member 22 stands vertically. A horizontal sheave shaft 23 is disposed on an intermediate portion of the sheave supporting member 22. The speed governor sheave 17 is supported on the sheave supporting member 22 by means of the sheave shaft 23, and rotates around the sheave shaft 23.

An inertia sheave 24 is disposed on the sheave shaft 23. The inertia sheave 24 can rotate around the sheave shaft 23 independently from the speed governor sheave 17.

A rope gripping mechanism 25 that grips the speed governor rope 18 is disposed on the base 21. The rope gripping mechanism 25 has a fixed shoe 26, a movable shoe 27, and a shoe supporting lever 28. The fixed shoe 26 is fixed onto the base 21. The movable shoe 27 is rotatably displaceable between a separated position that is separated from the speed governor rope 18 (solid lines in FIG. 2), and a gripping position that grips the speed governor rope 18 against the fixed shoe 26 (double-dotted chain lines in FIG. 2).

The shoe supporting lever 28 is rotatably disposed on the sheave supporting member 22. A lower end portion of the shoe supporting lever 28 is hooked onto the movable shoe 27. The movable shoe 27 is thereby held in the separated position during normal operation.

When the shoe supporting lever 28 rotates clockwise in FIG. 2, the movable shoe 27 is disengaged from the shoe supporting lever 28, and the movable shoe 27 rotates counterclockwise in FIG. 2 under its own weight. The tip of the movable shoe 27 thereby faces the fixed shoe 26, and the speed governor rope 18 is gripped between the fixed shoe 26 and the movable shoe 27.

Figure 3:
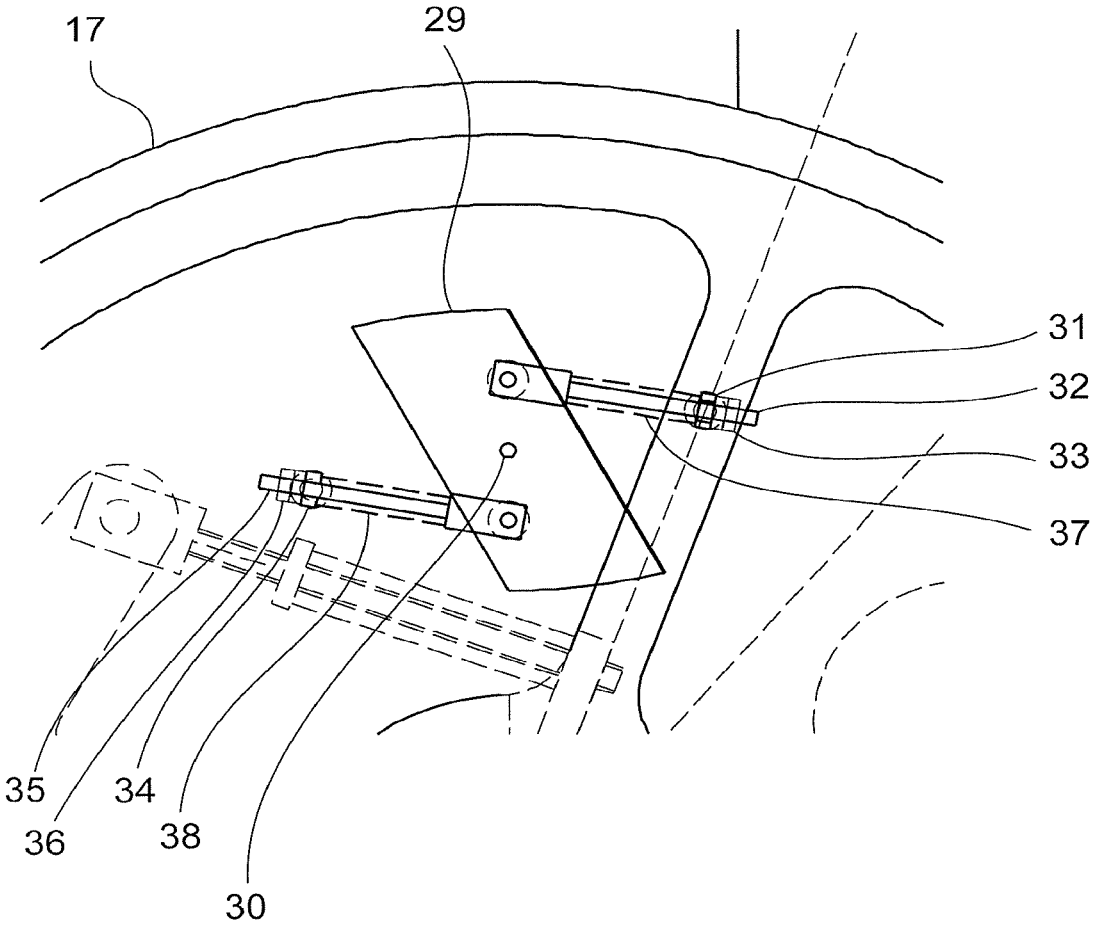
FIG. 3 is a front elevation that shows part of the speed governor from FIG. 2 enlarged in a state in which an inertia sheave has been removed.

FIG. 3 is a front elevation that shows part of the speed governor 16 from FIG. 2 enlarged in a state in which the inertia sheave 24 has been removed. A parallelogram-shaped pawl 29 is disposed between the speed governor sheave 17 and the inertia sheave 24. The pawl 29 is mounted to the inertia sheave 24 so as to be rotatable around a pawl rotating shaft 30.

The pawl 29 is displaceable between a normal position (FIG. 3) that does not contact the shoe supporting lever 28 even if the inertia sheave 24 rotates, and an activating position (FIG. 4) that contacts the shoe supporting lever 28 due to the rotation of the inertia sheave 24.

The pawl rotating shaft 30 is parallel to the sheave shaft 23. Furthermore, the pawl rotating shaft 30 is disposed at a center of gravity of the pawl 29.

A first pin 31 that functions as a first shaft holding portion is disposed on the speed governor sheave 17. The first pin 31 can rotate around a shaft that is parallel to the pawl rotating shaft 30. A first linking shaft 32 is disposed between the pawl 29 and the first pin 31. Specifically, the first linking shaft 32 is linked between the pawl 29 and the speed governor sheave 17.

A first end portion of the first linking shaft 32 is linked to the pawl 29 so as to be rotatable around a shaft that is parallel to the pawl rotating shaft 30. A second end portion of the first linking shaft 32 passes through an aperture that is disposed on the first pin 31, and is held slidably by the first pin 31.

A first double nut 33 that prevents dislodging of the first linking shaft 32 from the first pin 31 is mounted to a second end portion of the first linking shaft 32. The pawl 29 is connected to the speed governor sheave 17 by means of the first linking shaft 32, the first double nut 33, and the first pin 31.

A second pin 34 that functions as a second shaft holding portion is disposed on the inertia sheave 24. The second pin 34 can rotate around a shaft that is parallel to the pawl rotating shaft 30. A second linking shaft 35 is disposed between the pawl 29 and the second pin 34. Specifically, the second linking shaft 35 is linked between the pawl 29 and the inertia sheave 24.

A first end portion of the second linking shaft 35 is linked to the pawl 29 so as to be rotatable around a shaft that is parallel to the pawl rotating shaft 30. A second end portion of the second linking shaft 35 passes through an aperture that is disposed on the second pin 34, and is held slidably by the second pin 34.

A second double nut 36 that prevents dislodging of the second linking shaft 35 from the second pin 34 is mounted to a second end portion of the second linking shaft 35. The pawl 29 is connected to the inertia sheave 24 by means of the second linking shaft 35, the second double nut 36, and the second pin 34.

A first elastic body 37 is disposed between the first pin 31 and the first linking shaft 32. A helical spring that surrounds an intermediate portion of the first linking shaft 32, for example, can be used as the first elastic body 37.

A second elastic body 38 is disposed between the second pin 34 and the second linking shaft 35. A helical spring that surrounds an intermediate portion of the second linking shaft 35, for example, can be used as the second elastic body 38.

The first elastic body 37 pushes the pawl 29 in a direction in which a portion of the first linking shaft 32 that is linked to the pawl 29 separates from the first pin 31. The second elastic body 38 pushes the pawl 29 in a direction in which a portion of the second linking shaft 35 that is linked to the pawl 29 separates from the second pin 34.

By applying initial pressure, the first and second elastic bodies 37 and 38 hold the pawl 29 in the normal position when acceleration of the car 8 is less than abnormal acceleration (when the car 8 travels at a constant speed and when the car 8 travels at normal acceleration (0.98 $m/s^2$, for example)), and also allow the inertia sheave 24 to rotate together in synchronization with the speed governor sheave 17.

When the speed governor 16 is viewed from the front, the first and second pins 31 and 34, the first and second linking shafts 32 and 35, the first and second double nuts 33 and 36, and the first and second elastic bodies 37 and 38 are respectively disposed symmetrically relative to the pawl rotating shaft 30. In other words, the pawl 29 is linked to the speed governor sheave 17 and the inertia sheave 24 so as to have point symmetry around the pawl rotating shaft 30.

The abnormal acceleration detecting mechanism 40 according to Embodiment 1 includes the inertia sheave 24, the pawl 29, the pawl rotating shaft 30, the first pin 31, the first linking shaft 32, the first double nut 33, the second pin 34, the second linking shaft 35, the second double nut 36, the first elastic body 37, and the second elastic body 38. The abnormal acceleration detecting mechanism 40 detects abnormal acceleration (9.8 $m/s^2$, for example) of the car 8 due to breakage of the suspending body 7, and displaces the movable shoe 27 to the gripping position to activate the safety device 14.

Figure 4:
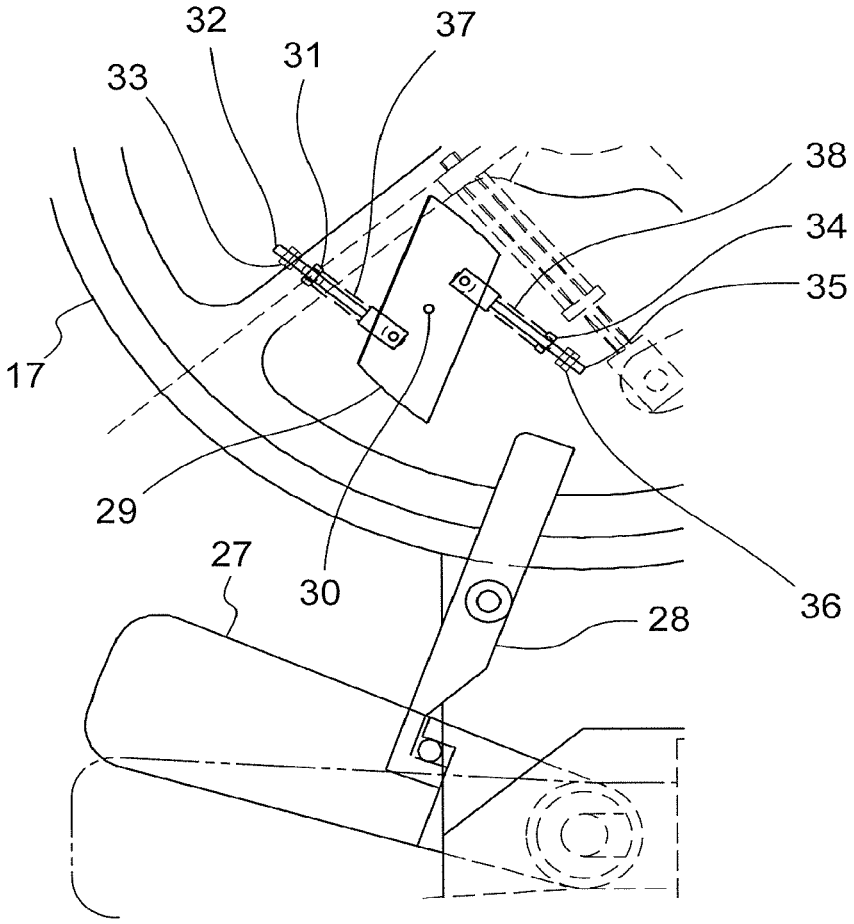
FIG. 4 is a front elevation that shows a state in which a pawl from FIG. 3 is displaced to an activating position.

Specifically, if downward acceleration of the car 8 reaches abnormal acceleration due to breakage of the suspending body 7, then the force of inertia that acts between the speed governor sheave 17 and the inertia sheave 24 exceeds the initial pressure, and a shift in the inertia sheave 24 in the direction of rotation relative to the speed governor sheave 17 occurs, displacing the pawl 29 to the activating position, as shown in FIG. 4.

As the inertia sheave 24 rotates further in this state, the pawl 29 contacts the shoe supporting lever 28 such that the shoe supporting lever 28 is rotated and the movable shoe 27 is disengaged from the shoe supporting lever 28. The movable shoe 27 thereby rotates counterclockwise in FIG. 4, and the speed governor rope 18 is gripped. As the car 8 then falls further, the activating lever 15 is pulled upward, activating the safety device 14.

In an elevator apparatus of this kind, because the pawl 29 is displaced to the activating position using the force of inertia that acts between the speed governor sheave 17 and the inertia sheave 24 to activate the safety device 14 when a suspending body breaks, the safety device 14 can be activated without having to wait for car speed to reach an overspeed, and adjustment for activating the safety device 14 can be performed easily irrespective of specifications. Consequently, complexity of torque design and factory adjustment that are imparted to the activating lever 15 by specifications of the elevator apparatus can be resolved.

Because the pawl rotating shaft 30 is disposed at the center of gravity of the pawl 29, the pawl 29 is less likely to be affected by centrifugal force.

In addition, because the first pin 31, the first linking shaft 32, the second pin 34, the second linking shaft 35, the first elastic body 37, and the second elastic body 38 are disposed in the abnormal acceleration detecting mechanism 40, abnormal acceleration can be detected using a simple configuration. Moreover, because these parts are disposed so as to have point symmetry relative to the pawl rotating shaft 30, the abnormal acceleration detecting mechanism 40 is less likely to be affected by centrifugal force.

Moreover, a damper for damping vibration of the elastic body may be disposed on the abnormal acceleration detecting mechanism. A friction damper may be disposed as such a damper on portions of the first and second linking shafts 32 and 35 that slide relative to the first and second pins 31 and 34, on a side surface of the pawl rotating shaft 30 or the inertia sheave 24, or on the rotating shaft portion of the inertia sheave 24, for example.

In the above example, the pawl 29 is mounted to the inertia sheave 24, but may be mounted to the speed governor sheave 17.

In addition, in the above example, the car 8 is shown as the ascending/descending body, but the ascending/descending body may be the counterweight 9.

Furthermore, in the above example, the speed governor sheave 17 is shown as the interlocking sheave, and the speed governor rope 18 is shown as the activating rope, respectively, but an interlocking sheave and an activating rope exclusively for abnormal acceleration detection may be disposed on the elevator apparatus separately from a speed governor or without using a speed governor.

The overall elevator apparatus equipment layout and roping method, etc., are not limited to the example in FIG. 1. The present invention can also be applied to two-to-one (2:1) roping elevator apparatuses, for example. Furthermore, the position and number of hoisting machines, for example, are also not limited to the example in FIG. 1.

In addition, the present invention can be applied to various types of elevator apparatus, such as elevator apparatuses that have no machine room, double-deck elevators, or single-shaft multi-car elevators, for example.

The invention claimed is:

1. An elevator apparatus comprising:

an ascending/descending body;

a suspending body that suspends the ascending/descending body;

a hoisting machine that raises and lowers the ascending/descending body by means of the suspending body;

a safety device that is mounted to the ascending/descending body, and that makes the ascending/descending body perform emergency stopping;

an activating rope that is installed in a loop inside a hoistway, and that is connected to the safety device;

an interlocking sheave onto which the activating rope is wound, and that rotates around a sheave shaft together with the raising and lowering of the ascending/descending body;

a movable shoe that is displaceable between a separated position that is separated from the activating rope, and a gripping position in which the activating rope is gripped, the movable shoe being held in the separated position during normal operation; and an abnormal acceleration detecting mechanism that detects abnormal acceleration of the ascending/descending body due to breakage of the suspending body, and that displaces the movable shoe to the gripping position to activate the safety device, wherein the abnormal acceleration detecting mechanism comprises:

an inertia sheave that is rotatable around the sheave shaft and is different from the interlocking sheave;

a pawl that is connected to the interlocking sheave and the inertia sheave, and that is displaceable between a normal position, and an activating position that displaces the movable shoe to the gripping position; and an elastic body that holds the pawl in the normal position by applying an initial pressure, and that also rotates the inertia sheave together with the interlocking sheave, and a force of inertia that acts between the interlocking sheave and the inertia sheave exceeds the initial pressure if acceleration of the ascending/descending body reaches the abnormal acceleration due to breakage of the suspending body, which causes a shift of the interlocking sheave in a direction of rotation relative to the inertia sheave such that there is a shift in position of a point on the interlocking sheave relative to a point on the inertia sheave which causes the pawl to move to the activating position to displace the movable shoe to the gripping position.

2. The elevator apparatus according to claim 1, wherein the pawl is mounted to any one of the interlocking sheave and the inertia sheave so as to be rotatable around a pawl rotating shaft, and the pawl rotating shaft is disposed so as to be parallel to the sheave shaft at a position of center of gravity of the pawl.

3. The elevator apparatus according to claim 1, wherein the abnormal acceleration detecting mechanism further comprises:

a first linking shaft that is linked between the pawl and the interlocking sheave; and a second linking shaft that is linked between the pawl and the inertia sheave, the first linking shaft is held slidably on a first shaft holding portion that is rotatably disposed on the interlocking sheave, and is also rotatably linked to the pawl, the second linking shaft is held slidably on a second shaft holding portion that is rotatably disposed on the inertia sheave, and is also rotatably linked to the pawl, and the elastic body includes:

a first elastic body that is disposed between the first linking shaft and the first shaft holding portion; and a second elastic body that is disposed between the second linking shaft and the second shaft holding portion.

4. The elevator apparatus according to claim 3, wherein the pawl is mounted to any one of the interlocking sheave and the inertia sheave so as to be rotatable around a pawl rotating shaft, the pawl rotating shaft is disposed so as to be parallel to the sheave shaft at a position of center of gravity of the pawl, and the first and second shaft holding portions, the first and second linking shafts, and the first and second elastic bodies are respectively disposed mutually symmetrically relative to the pawl rotating shaft.

* * * * *